United States Patent [19]

Schreck et al.

[11] Patent Number: 4,953,289

[45] Date of Patent: Sep. 4, 1990

[54] CONDUCTOR TERMINATING METHOD

[75] Inventors: Daniel J. Schreck, Lansdale; Ronald G. Ehrmann, Warrington, both of Pa.

[73] Assignee: Pyle Overseas B.V., Amsterdam, Netherlands

[21] Appl. No.: 361,128

[22] Filed: Jun. 5, 1989

[51] Int. Cl.[5] ..... H01R 43/04

[52] U.S. Cl. ..... 29/863; 174/94 R; 439/800; 439/877; 439/880

[58] Field of Search ..... 439/800, 877, 880; 29/863, 861; 174/117 F, 94 R

[56] References Cited

U.S. PATENT DOCUMENTS

| | | | |
|---|---|---|---|
| 2,247,041 | 6/1941 | Bergan | 439/877 |
| 2,806,214 | 9/1957 | Forney, Jr. | 439/800 X |
| 3,040,292 | 6/1962 | Bernard et al. | 439/800 |
| 3,956,823 | 5/1976 | Kuo | 29/863 |
| 4,707,566 | 11/1987 | Titcombe et al. | 439/877 X |

FOREIGN PATENT DOCUMENTS

| | | | |
|---|---|---|---|
| 4146 | 9/1979 | European Pat. Off. | 439/877 |
| 2341900 | 2/1975 | Fed. Rep. of Germany | 439/800 |
| 2728390 | 1/1979 | Fed. Rep. of Germany | 439/880 |

*Primary Examiner*—Carl E. Hall
*Assistant Examiner*—Carl J. Arles
*Attorney, Agent, or Firm*—McCormick, Paulding & Huber

[57] ABSTRACT

A flat conductor of indeterminate length having a generally rectangular cross-section is terminated by forming a terminal which includes a seamless tubular barrel portion having a cylindrical bore, flattening the barrel portion to alter the cross-sectional configuration of the bore to generally complement the cross-sectional configuration of the conductor to be terminated, inserting the end portion of the conductor into the flattened barrel and swaging opposite sides of the flattened barrel in a controlled manner to simultaneously form indentations in opposite sides of the barrel which project into the bore and deform associated opposite flat sides of the end portion received therein.

6 Claims, 1 Drawing Sheet

CONDUCTOR TERMINATING METHOD

BACKGROUND OF THE INVENTION

This invention relates in general to electrical conductor terminations and deals more particularly with a method for terminating flat electrical conductors.

It is the general aim of the present invention to provide an improved method for controlled crimp termination of a flat electrical conductor or a high density array of flat conductors which insures a highly reliable electrical union while providing mechanical resistance to axial forces on the union in excess of conductor strength.

SUMMARY OF THE INVENTION

In accordance with the present invention, a flat conductor of indeterminate length and having a generally rectangular cross-section is terminated by forming a terminal which includes a seamless tubular barrel portion having a cylindrical bore. The barrel portion is flattened to alter the cross-sectional configuration of its bore to generally complement the cross-sectional configuration of an associated portion of the conductor to be terminated. An end portion of the conductor is inserted into the bore and thereafter a controlled swaging operation is performed on opposite sides of the flattened barrel to form indentations in said opposite sides which project into the bore and deform associated opposite flat sides of the end portion received therein.

DETAILED DESCRIPTION OF PREFERRED METHOD

Figure 1:
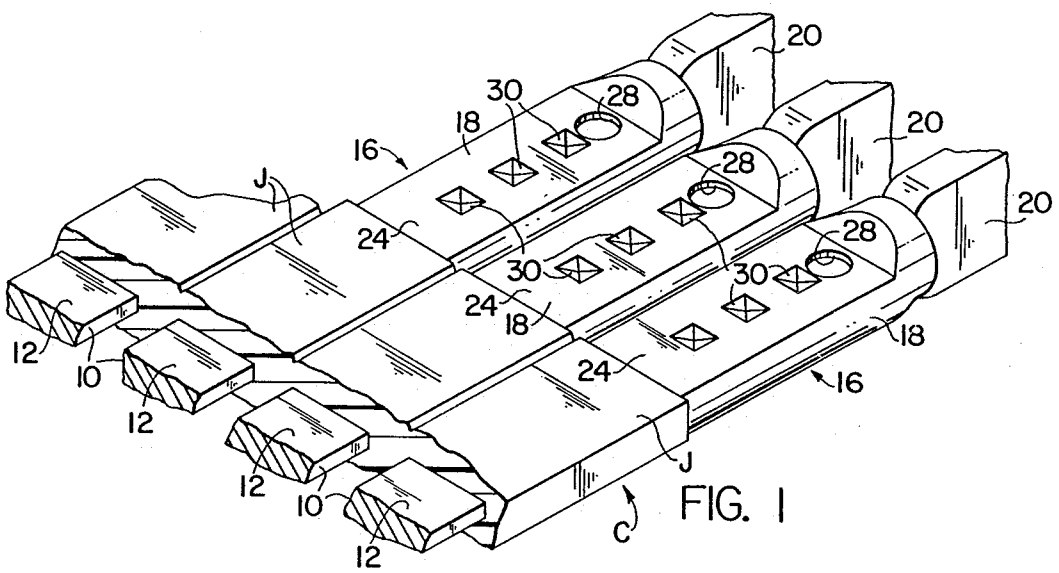
FIG. 1 is a fragmentary perspective view of a ribbon cable containing a plurality of flat electrical conductors and terminated in accordance with the present invention.
Figure 2:
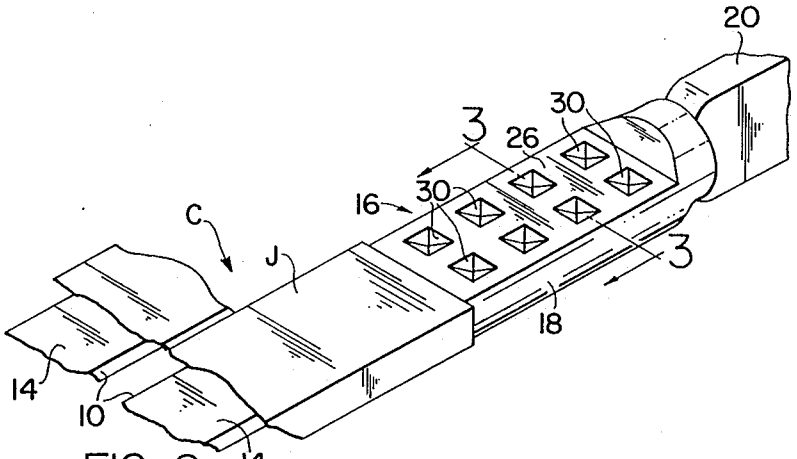
FIG. 2 is a fragmentary perspective view showing the opposite side of the terminated ribbon cable of FIG. 1.

The method of the present invention is particularly adapted for terminating a single flat electrical conductor or simultaneously terminating a high density array of flat conductors, such as the conductors contained within a ribbon cable or the like. Such a ribbon cable is shown in FIG. 1, indicated generally by the letter C, and terminated in accordance with a method of the present invention. The terminated ribbon cable C includes a plurality of flat electrical conductors 10,10 contained within a common electrical insulation jacket J. Each conductor 10 has a generally rectangular cross-section partially defined by substantially flat upper and lower surfaces, indicated at 12 and 14, respectively. Each conductor 10 is terminated by an associated electrical terminal, indicated generally at 16, which includes a ferrule or barrel portion 18 and a contact portion 20. The contact portions of the illustrated terminals 16,16 may be made in various forms to satisfy differing electrical connection requirements, therefore, the contact portions 20,20 are not fully shown.

Figure 4:
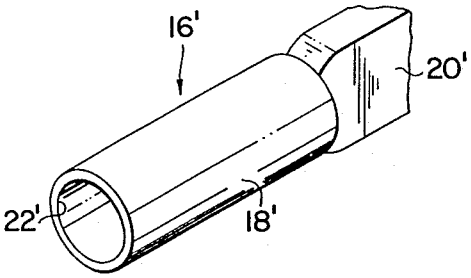
FIG. 4 is a fragmentary perspective view of a partially formed terminal.

A typical partially formed terminal is shown in FIG. 4, indicated generally at 16', and has a substantially cylindrical seamless tubular ferrule or barrel portion 18' and a coaxially generally cylindrical bore 22'. The tubular barrel 18' is preferably formed from solid metal by a machining operation. Thus, for example, the barrel may be formed by a turning operation while the tubular bore 22', which is preferably blind, is or may be simultaneously formed by a boring operation, the latter operations being typically performed by an automatic screw machine or the like.

The partially formed terminal 16' is further formed to receive an associated conductor 10 by flattening the generally cylindrical seamless tubular barrel 18' in a controlled manner between a pair of mating dies to alter the cross-sectional shape of the cylindrical bore 22' to conform to and substantially complement an associated portion of the cross-section of a flat conductor 10 to be received therein.

Figure 5:
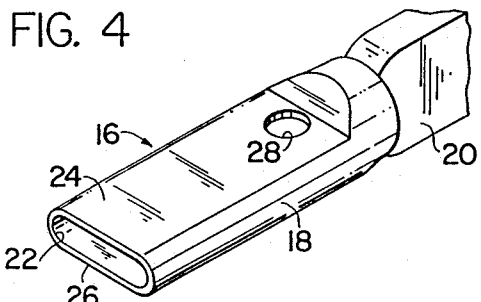
FIG. 5 is a perspective view of a formed terminal.

Referring now to FIG. 5, a typical terminal is shown after the flattening operation has been performed to reshape the barrel portion. The reshaped terminal, now indicated by the numeral 16, has substantially flat upper and lower barrel surfaces, indicated at 24 and 26, respectively. It will be noted that the shape of the bore, now indicated by the numeral 22, has been altered so that a portion of the bore cross-section substantially complements a portion of the cross-section of an associated conductor 10 to be received therein.

A sighting hole 28 is drilled, punched, bored or otherwise formed in the barrel portion 18 to open into the bore 22 near its inner or blind end, substantially as shown in FIG. 5.

In making the ribbon cable assembly shown in FIG. 1, an end part of the insulation jacket J is first stripped from the cable conductor C to expose an end portion of each conductor 10. The length of the exposed conductor end portion should be substantially equal to the axial length of the blind bore 22 of an associated terminal. The exposed end portion of each conductor 10 is next inserted into the substantially complementary bore 22 of an associated terminal. The sighting openings 28,28 permit visual inspection of the conductor/barrel assemblies to assure that each conductor is fully and properly positioned within an associated barrel portion 18 before the final operation is performed on the assembly to unify it.

Figure 3:
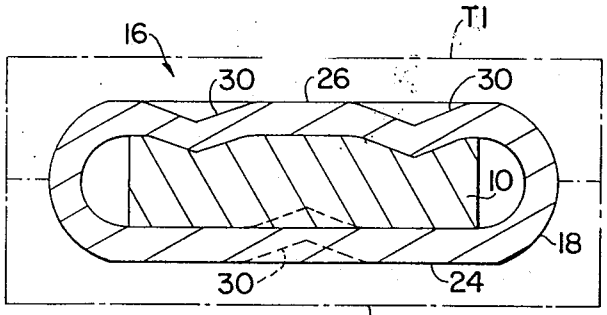
FIG. 3 is a sectional view taken along the line 3—3 of FIG. 2 and illustrating a termination method.

The terminals 16,16 are joined to the cable C by arranging the terminals in parallel relation to each other and simultaneously swaging or crimping the opposite flat surface portions 24 and 26 of the terminal barrels in a controlled manner hereinafter described. Specifically, the swaging or crimping operation is preferably performed on each terminal 16 by a pair of opposing swaging or crimping tools which engage and simultaneously form crimped or swaged patterns in the flat opposite top and bottom surfaces 24 and 26, respectively, to retain each conductor 10 within an associated barrel portion and establish a plurality of gas tight connections between the barrel portion and the flat connector contained therein. The swaging tools, indicated somewhat schematically by broken lines in FIG. 3 at $T_1$ and $T_2$ are shown in closed or swaging position. In the latter positions, the tools substantially surround the exposed peripheral surface of the barrel portion 18 to prevent it from spreading as indentations 30,30 are formed in it by the tools.

The tooling is designed to provide two spaced apart columns of crimps or indentations 30,30 in one flat surface of an associated barrel portion, each column comprising a plurality of spaced apart rows of indentations 30,30. The tooling is further adapted to provide at least one column of indentations including at least one indentation 30 in the opposite or upper flat side of the barrel. The column on the other side being in substantial opposing registry with the spaces between the columns of indentations formed in the one flat side of the barrel.

The shape of the indentations formed by the staking or crimping operation may vary. However, the presently preferred tooling is constructed to form pyramid shaped indentations 30,30 in the flat top and bottom surfaces 24 and 26 to produce corresponding substantially complementary projections on the respective flat inner surfaces of the barrel portion extending into the bore 22.

The opposing staggered relationship between the indentations on one flattened side of the barrel portion and those on the opposite flattened side of the barrel portion are such that the resulting projections within the barrel portion are not disposed in directly opposing relation to each other. The resilient materials from which the conductor and the seamless barrel are made enable the projections to maintain a constant biasing force against the corresponding deformed surfaces of the conductor so that substantially gas tight seals are maintained therebetween to provide electrical connections of high integrity and resistance to axial separation force which exceeds the strength of the conductors.

We claim:

1. A method for terminating a solid flat conductor of indeterminate length having a generally rectangular cross-section and comprising the steps of forming a terminal including an axially elongated seamless tubular barrel portion having a cylindrical bore, flattening said tubular barrel portion to flatten the cross-sectional configuration of said bore to generally complement the cross-sectional configuration of an associated end portion of said solid flat conductor, inserting said associated end portion of said solid flat conductor into said flattened bore, and simultaneously swaging opposing flattened surfaces of said barrel portion forming a plurality of spaced apart columns of indentations in one of said opposing surfaces and at least one column of indentations in the other of said opposing surfaces, the indentations in said other opposing surface being out of opposing registry with the indentations in said one opposing surface, said indentations deforming said associated end portion within said bore.

2. A method for terminating a flat conductor of indeterminate length having a generally rectangular cross-section and comprising the steps of forming a terminal including an axially elongated seamless tubular barrel portion having a cylindrical bore, flattening opposing surfaces of said tubular barrel portion to flatten the cross-sectional configuration of said bore to generally complement the cross-sectional configuration of an associated end portion of said flat conductor, inserting said associated end portion of said flat conductor into the flattened bore, and simultaneously swaging opposing flattened surfaces of said barrel portion forming a plurality of spaced apart columns of indentations in one of said opposing flattened surfaces and at least one column of indentations in the other of said opposing flattened surfaces in opposing registry with a space between adjacent columns of said indentations formed in said one opposing surface, each of said columns including at least one indentation, said indentations projecting into said bore and deforming said associated end portion.

3. A method for terminating a flat conductor as set forth in claim 2 wherein the step of forming a terminal is further characterized as machining said seamless tubular barrel portion from solid stock.

4. A method for terminating a flat conductor as set forth in claim 2 wherein the step of forming a terminal is further characterized as forming a terminal including a seamless tubular barrel portion having a cylindrical blind bore and including the additional step of forming a sighting aperture in said seamless tubular barrel portion communicating with the blind end of said bore.

5. A method for terminating a flat conductor as set forth in claim 2 wherein the step of swaging is further characterized as swaging said tubular barrel portion to form pyramid shaped indentations therein.

6. A method for terminating a plurality of substantially identical flat conductors of generally rectangular cross-section and indeterminate length and comprising the steps of forming a plurality of terminals equal in number to said conductors and including seamless tubular barrel portions having cylindrical bores, flattening opposing outer surfaces of said tubular barrel portions to flatten the cross-sectional configurations of said bores to generally complement the cross-sectional configurations of associated end portions of said conductors, inserting an end portion of each of said conductors into an associated one of said flattened bores, arranging said conductors in parallel relation to each other with said terminals thereon in side-by-side relation, and simultaneously swaging each barrel portion forming a plurality of spaced apart columns of indentations in one of said opposing flattened outer surfaces thereof and at least one column of indentations in the other of said opposing flattened outer surfaces thereof in opposing registry with a space between adjacent columns formed in said one of said opposing flattened outer surfaces, said indentations projecting into the bore thereof and deforming an associated end portion within said bore.

* * * * *